United States Patent [19]

Apellaniz

[11] 4,017,079

[45] Apr. 12, 1977

[54] TABLE GAME

[76] Inventor: Norberto Apellaniz, 2360 First Ave., New York, N.Y. 10035

[22] Filed: Mar. 17, 1975

[21] Appl. No.: 558,903

[52] U.S. Cl. ..... 273/126 R

[51] Int. Cl.[2] ..... A63F 3/00

[58] Field of Search ..... 273/126 R, 108, 118 R, 273/119 R, 119 A, 4 A, 3 R, 125 R, 125 A, 120 R, 120 A, 121 R, 121 A, 122 R, 122 A, 123 R, 123 A, 113, 127 R, 113 R

[56] References Cited

UNITED STATES PATENTS

| | | | |
|---|---|---|---|
| 566,309 | 8/1896 | Grassow | 273/126 R |
| 623,597 | 4/1899 | Erickson | 273/126 R |
| 828,211 | 8/1906 | Johnson | 273/123 R |
| 1,349,587 | 8/1920 | Smith et al. | 273/126 R |
| 1,368,401 | 2/1921 | Kettle | 273/126 R |
| 1,502,607 | 7/1924 | Wright | 273/126 R |
| 1,962,576 | 6/1934 | Yürgen et al. | 273/126 R |
| 3,008,718 | 11/1961 | Berliner | 273/126 R |
| 3,464,699 | 9/1969 | Dollar | 273/118 R |
| 3,764,144 | 10/1973 | Arthur | 273/126 A |
| 3,802,707 | 4/1974 | Frost | 273/123 R |

FOREIGN PATENTS OR APPLICATIONS

| | | | |
|---|---|---|---|
| 449,090 | 6/1948 | Canada | 273/125 R |

*Primary Examiner*—Harland S. Skogquist
*Assistant Examiner*—T. Brown
*Attorney, Agent, or Firm*—Marvin Feldman

[57] ABSTRACT

A table game having a square board playing surface suitable for several players to be arranged around the board and a plurality of symmetrically disposed pockets at corners and sides of the board, and a plurality of discs adapted to be slidably propelled across the board by flicking the finger of the player against the disc, and a disc being received in the pocket. The board is provided with resilient raised portions to permit carom deflections of the propelled disc. The symmetrical arrangement of the board, pockets and markings permits several players to compete without disadvantage to any one player. Several game variations are achievable.

10 Claims, 6 Drawing Figures

TABLE GAME

The present invention relates to a table game having a smooth board surface with symmetrically disposed pockets, and discs adapted to be propelled into the pockets by flicking a finger against the side of the disc.

Heretofore certain pocketed board game arrangements provided for play by usually only a limited number of players, with one player at a time assuming a shooting position at a specific side of the board. Often players had to move back and forth to a particular side of the board in playing the game. Also certain prior art games had limitations in variation of play with each particular game.

Further in prior art games, special cues or sticks were usually necessitated for propelling the discs.

Now there is provided a table game wherein several players may be arranged at sides of a pocketed board and wherein each player simultaneously or in turn flicks a disc with his finger to propel the disc against other discs or carom the disc off resilient elevated surfaces of the board so as to propel discs in the pockets. Each player regardless of which side of the board he is positioned, has the same view of the symmetrically disposed board as another player positioned at another side of the board.

It is therefore an object of this invention to provide a game board wherein players as shooters are disposed at respective sides of the board during play.

It is also an object of this invention to provide a game board which readily permits several variations of play with several players.

It is a further object of this invention to provide game board as aforesaid wherein a plurality of discs are adapted to be propelled across the board by a player striking his finger against the side of the disc.

It is still a further object of this invention to provide a plurality of pockets symmetrically disposed about the board for receiving the propelled discs.

It is still of further object of this invention to provide a pocketed board game as aforesaid where two side pockets are adjacent one another and separated by a distance about equal to the major dimension of the disc.

It is still a further object of this invention to provide a game board with a center recess for receiving a propelled disc.

It is still a further object of this invention as immediately aforesaid to provide insert means to convert the recess so as to be flush with the game board surface.

It is still of further object of this invention as immediately aforesaid wherein another insert means provides an elevated portion having a resilient periphery so as to permit the propelled discs to carom from the peripheral surface.

The aforesaid as well as other objects and advantages will be made clear in a reading of the following specification and adjoined claims, and the accompanying drawing in which:

Figure 3A:
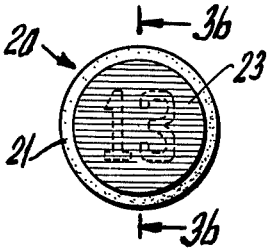
Figure 3B:
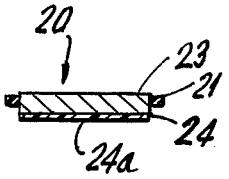

FIG. 3*a* is a plan view of a coded disc;

FIG. 3*b* is a sectional view taken along line 3*b*–3*b* of FIG. 3*a;*

Figure 3C:
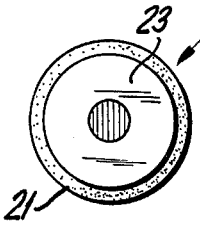

FIG. 3*c* is a plan view of a cue disc; and

Figure 1:
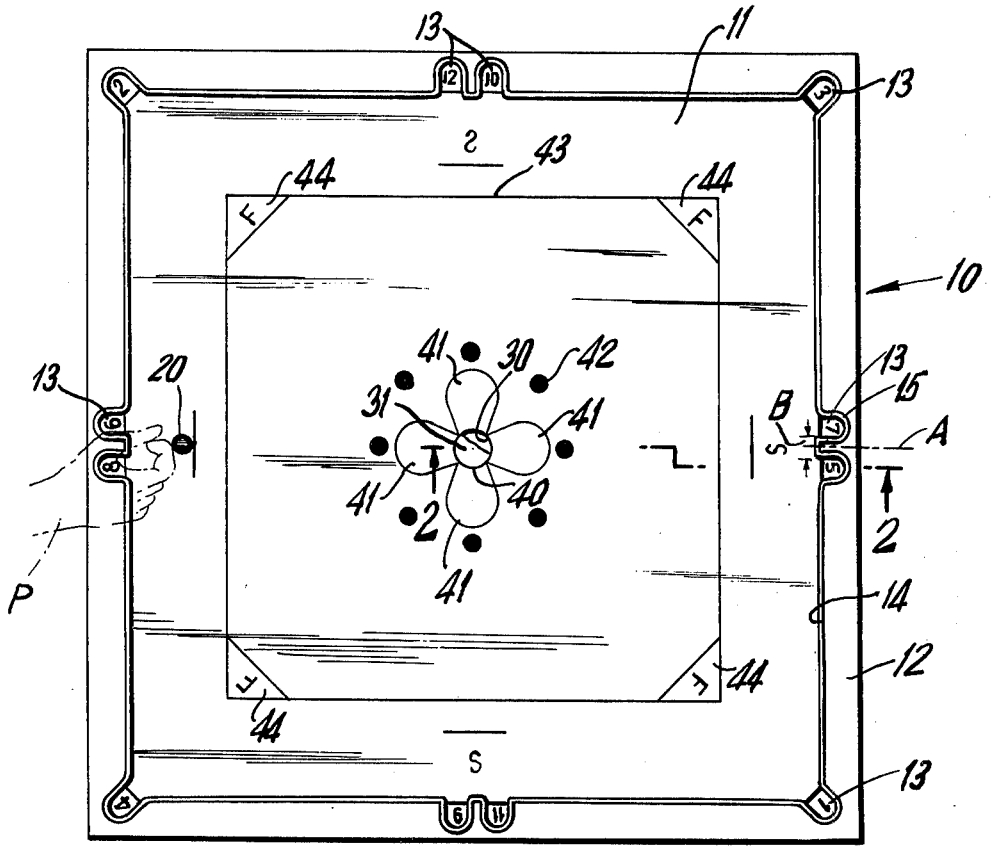
FIG. 1 is a top plan view of the table game.
Figure 4:
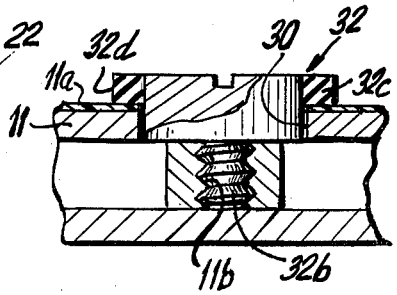

FIG. 4 is an enlarged sectional view of an alternate form of the center portion of the game board as shown in FIG. 1.

Figure 2:
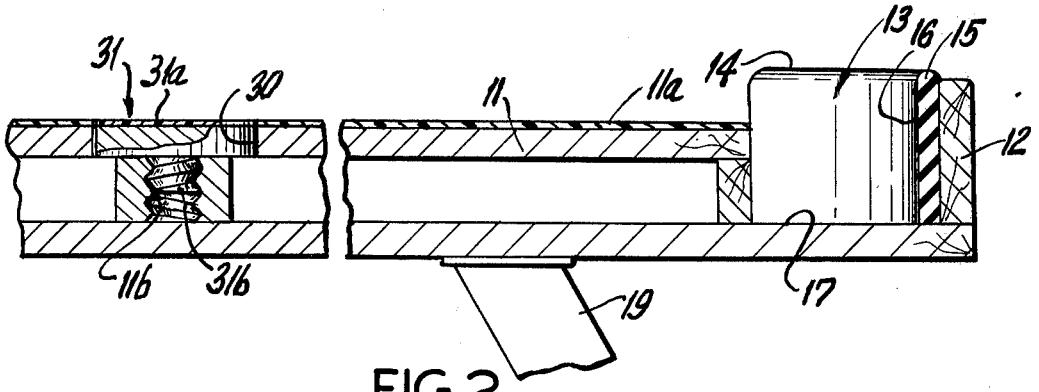
FIG. 2 is a partial sectional view taken along line 2—2 of FIG. 1.

Referring now to FIGS. 1 and 2 there is shown the table game generally as 10, comprising a 40-inch square game board 11, having a plastic coated or covered surface 11*a*, frame 12, elevated side walls 14, legs 19 and twelve numbered pockets 13 (typical) disposed about the game board 11 and recessed in side wall 14 and frame 12. Each pocket 13 is numbered in seriatim, nos. 1 through 12, for reasons as will be more fully explained hereinafter. A resilient rubber cushion member 15 covers side walls 14 and the pocket side walls 16 so as to permit a propelled disc 20 to carom from the member if desired.

Each pocket 13 is sized so as to permit the disc 20 to be received in the pocket and remain at the bottom 17 of the pocket. The pocket numbers may be inscribed at bottom 17 for ease in downward viewing. Pockets Nos. 1–4, are corner pockets whereas pockets nos. 5–12 are side pockets. Each pair of adjacent side pockets, namely 5 and 7, 6 and 8, 9 and 11, and 10 and 12 is disposed so that one pocket each is disposed on opposite sides of a center line A, and the distance between each pocket as measured by dimension line B is about equal to the diameter of disc 20. For example in the game board shown, disc 20 is about ¼ inch in height and about 1½ inches in overall diameter, and dimension B is from about 1⅛ inches to about 1⅞ inches. In addition each pocket 13 measures at least about 1⅞ inches in all dimensions across the pocket opening so as to permit disc 20 to be received in any pocket 13. Dimension or portion B of the side wall becomes important in play as for example as shown in FIG. 1, player P aims disc 20 to be received in pocket 5 but must avoid adjacent pocket 7, while alternatively may utilize portion B for purposes of caromming a propelled disc. Shooting, aiming or alignment markings may be added to cushion 15.

Two sets of discs are provided; a first set comprising thirteen blue cylindrical discs, numbered in seriatim and a corresponding white or light yellow cue disc with a corresponding blue circular center portion; the second set being similar to the first set except being red coded as opposed to blue coded. Referring to FIGS. 3*a* and 3*b*, there is shown the no. 13 blue disc 20 and in FIG. 3*c* there is shown the red cue disc 22. Each disc 20 and 22 comprises a flat cylindrical body member 23 having a plastic coated or covered bottom 24, so that disc bottom surface 24*a* may be in sliding engagement with board surface 11with minimum of friction. Teflon coated board and disc surfaces are within the contemplation of this invention as well as air cushioned board surfaces such as found in "air hockey" games are also within the contemplation of this invention so as to provide a minimum of friction in sliding a disc across the board surface. Further each disc is provided with an annular contractable resilient rubber member 21, which rubber member 21 serves a dual purpose. Firstly, the rubber member 21 serves to resiliently engage resilient side walls of the game board or resilient side of any other disc to provide a resilient carom effect in either case, and secondly, the disc may be propelled by a player P flicking his index finger against the rubber member 21. Member 21 is spaced above bottom 24 so as to provide clearance portion 25 between the board surface 11*a* and the rubber member 21. By so providing this rubber member 21, a player P may shoot the disc numerous times without injury to the index finger.

Referring specifically to FIGS. 1 and 4 there is shown the center circular recess 30 and in FIG. 1 flush insert 31 is received in recess 30, whereas in FIG. 4 elevated insert 32 is received in recess 30. Recess 30 is at least about 1 9/16 inches in radius and 2/16 inches in depth, and the respective inserts 31 and 32 similarly dimensioned for clearance fit into the recess. This recess 30 without insert is sufficient to receive a disc. Insert 31 has a plastic coated or covered surface 31*a* so that when this insert is fully retained in recess 30, surface 31is flush with board surface 11*a*. Insert 31 is formed with an axially depending male threaded portion 31*b* which engages female threaded portion 11*b* of the game board. This threaded engagement holds insert 31 in place. To remove insert 31, the insert is turned so that it rises up on the threads 11*b*. Insert 32 is formed with a raised or elevated resilient annular bumper 32*c* extending about ½ inch above board surface 11*a* and has a lower axially depending male threaded portion 32*b* similar to 31*b* but of greater length. Insofar as insert 32 will be subject to side focus in playing the game whereas insert 31 would not, threaded portion 32*b* may be made somewhat longer than 31*b*, so as to retan insert 32 in place during play. Bumper 32*c* has a peripheral surface 32*d* for resilient engagement with the annular resilient member 21 of any disc.

By the aforesaid manner of construction the game may be played either with a center recess 30 for receiving a propelled disc, or alternatively with insert 31 for a contiguous flush surface with the board, or still alternatively with an insert 32 with raised bumper for effecting carom shots.

Referring now specifically to FIG. 1, several board markings are shown such as center circle 40 surrounding recess 30, four cloverleaf regions or areas 41, eight disc alignment dots 42, a square region 43 with four corner triangles 44, marked "F" and four starting lines, marked "S". Each region or areas 40, 41 and 44 is sufficiently large for a disc to be received in such region without touching the boundary lines. Dots 42 are about the diameter of the discs. The dots are radially disposed from the center of the board and four of the dots are colinear with the center of the board and the center of each respective corner pocket, while the other four dots are colinear with the center of the board and the midpoint of B. The starting lines are sufficiently spaced from the side walls to permit a disc to be placed just behind the starting line (see FIG. 1) while the player's hand rests on the board between the starting line nd the side wall. In this manner of construction a first disc may be placed on the dot most adjacent the particular pocket sought to be used to receive said first disc and a second disc is placed behind the starting line "S" most distant from the said particular pocket. In propelling the second disc against the first disc into the said particular pocket, one object of the game is achieved.

While the aforesaid table game is shown in wood construction it is understood that a molded plastic board frame and discs are also within the contemplation of this invention.

By the aforesaid manner of construction several modes of play are permissible, as follows:

In a first mode of play all color coded discs, twenty-six in total are racked or group together at one portion of the board. Several players usually four in number, are disposed around the board. One cue disc is placed opposite the grouped disc and the game is commenced by the first player "breaking" the group of discs by propelling the cue disc with his index finger flicking away from his thumb against the cue disc toward and into the grouped discs. Each player seeks to place as many discs as possible into any pocket or pockets. The object of the game is to achieve the most pocketed discs. A player continues each turn until he misses a shot whereupon the next player takes his turn.

The order of play may first be conveniently determined by each player placing a disc on a respective starting line and shooting for the center of the board. The player closest to the center goes first while the player whose disc is furthest from the center goes last and so forth.

The aforesaid mode of play can be played with or without the center bumper.

Also the aforesaid mode may be played wherein one player or team of players shoots to score one color discs and the competitors shoot to score the other color discs. Further no cue disc need be employed and the players shoot the discs directly.

In a second mode of play, each player, assuming two players for the moment, gets an equal number of discs numbered in seriatim. One cue disc is placed behind a starting line and the particular number disc is placed on a dot most adjacent the corresponding numbered pocket and the player attempts to knock that disc from the dot into the corresponding numbered pocket. If the player misses, the discs remain in their respective position and the next player attempts to achieve his numbered disc in the corresponding pocket. If one player hits another players disc on a direct shot with the cue disc, the shooter loses a full turn of play. If however the other players disc is touched in a bank or carom shot the other player and not the shooter loses a turn of play. If however a carom shot knocks the other player's disc into the pocket or center recess (if present), the other player loses the entire game. Each player must successfully get each disc in seriatim in the corresponding number pocket. Only one color coded disc of each player may be on the board at any one time.

A variation of the above permits the players to use the cloverleaf regions so that when an opponents disc is carommed into a cloverleaf there is a penalty such as losing a turn. Likewise the triangular regions marked "F" may be used for a bonus situation such as obtaining a "free" or extra shot.

It is also within the contemplation of this invention that carom shots be used to block an opponent from his next intended shot.

With thirteen discs and twelve pockets, the last or 13th disc is placed at the starting line and sought to be propelled into the center recess or circle of the board, as the case may be. In achieving this last shot, this completes the game and the player first achieving this center shot wins.

As can be seen various modes of play are achievable with the board construction of this invention and several players may readily participate.

Thus, there has been described a game which is uncomplicated and simple to play; yet, requires dexterity in executing plays to score discs in the game.

It will be obvious to those skilled in the art that various modifications of the apparatus and game of the invention may be resorted to within the spirit of the invention.

What I claim is:

1. A game board comprising a board, side walls extending up from said board, at least one disc, at least one surface of the disc and the surface of the board being adapted to permit the disc to be propelled across the board by the flicking of a finger of a player, said board comprising a plurality of pockets for receiving the disc, and wherein at a side wall there are two pockets adjacent one another and separated by a distance approximately equal to the diameter of the disc in a plane parallel to the plane of the board, further comprising in a first mode of play said board being formed with a recess surface for receiving a propelled disc and in a second mode of play further comprising an insert adapted to fit said recess so as to provide a continuous flat board surface, and in a third mode of play, a second insert adapted to fit into said recess and being formed with a raised portion extending above the board surface and the peripheral surface of the raised portion being adapted to permit a propelled disc to carom from the peripheral surface.

2. The game board of claim 1, said board being square.

3. The game board of claim 1, wherein the disc has a diameter of about 1½ inches and the distance between adjacent side pockets if from about 1⅛ inches to about 1⅞ inches.

4. The game board of claim 1, wherein each disc comprises an annular resilient member being mounted on the cylindrical periphery and being adapted to be engaged by the flicking finger of the player.

5. The game board of claim 4, wherein said side walls are resilient.

6. The game board of claim 1, wherein each of the pockets are numbered in seriatim, and a first plurality of discs being numbered in seriatim and a second plurality of discs being numbered similarly in seriatim, and wherein said pluralities of discs are coded so as to be distinguishable, one from the other.

7. The game board of claim 6, further comprising two cue discs, one of said cue discs being coded to coordinate with said first plurality of discs and the other of said cue discs being coded to coordinate with said second plurality of discs.

8. The game board of claim 1, further comprising means to retain said insert in fixed position during play.

9. The game board of claim 1, wherein said recess is centrally disposed in said board.

10. The game board of claim 9, wherein there are twelve pockets.

* * * * *